US005697233A

United States Patent [19]

Albert et al.

[11] Patent Number: 5,697,233

[45] Date of Patent: Dec. 16, 1997

[54] TAMPER-PROOF DEVICE FOR LOCKINGLY ATTACHING A PIECE OF EQUIPMENT TO A SUPPORT BASE

[75] Inventors: André Albert; Bruno Archambault, both of Sherbrooke; Claude Thérer, Ascot, all of Canada

[73] Assignee: Baultar Inc., Québec, Canada

[21] Appl. No.: 798,127

[22] Filed: Feb. 12, 1997

[51] Int. Cl.[6] ..... E05B 73/00

[52] U.S. Cl. ..... 70/58; 70/34; 70/232; 70/422; 70/DIG. 57; 248/551; 248/553; 248/681

[58] Field of Search ..... 70/34, 57, 58, 70/62, 164, 229, 232, 422, DIG. 57; 248/551, 553, 680, 681

[56] References Cited

U.S. PATENT DOCUMENTS

| | | | |
|---|---|---|---|
| 3,612,469 | 10/1971 | Dennis | 248/551 X |
| 3,724,798 | 4/1973 | Lucasey | 248/553 X |
| 3,850,392 | 11/1974 | Gassaway | 248/553 |
| 3,965,705 | 6/1976 | Nadler | 248/553 X |
| 4,585,202 | 4/1986 | Parsekian | 248/680 X |
| 4,613,109 | 9/1986 | Boscacci | 248/553 |
| 4,696,449 | 9/1987 | Woo et al. | 248/553 |
| 4,739,637 | 4/1988 | Finkel et al. | 248/553 X |
| 4,809,943 | 3/1989 | Taschero | 248/553 X |
| 4,856,305 | 8/1989 | Adams | 70/164 X |
| 5,169,114 | 12/1992 | O'Neill | 248/680 X |

*Primary Examiner*—Lloyd A. Gall
*Attorney, Agent, or Firm*—Robic

[57] ABSTRACT

A tamper-proof device is provided for lockingly attaching a piece of equipment such as a TV set or a microwave oven to a support base. It has a pair of rigid plates that are respectively connected to the piece of equipment and the support base. One of the plates is surrounded by a flange which defines a closed area in which wedges are located to hook both plates together. The two plates are rigidly connected to each other by a screwable bolt that can be reached with a screw driver through a coaxial opening provided in the flange. A sleeve extends in between the head of the bolt and the opening. This sleeve can be closed by key-operated lock in order to prevent access to the bolt. The lock is free to rotate within the sleeve even when its latch is locked in outward position. Such prevents a theft from breaking the latch by forcing the lock into rotation in a cantilever fashion. A resilient plate is mounted within the closed area in such a manner as to extend radially close to the sleeve in order to contact the latch when the latch projects radially outwardly of the sleeve. This plate is resilient enough to let the latch flip over it if too much rotational force is applied to the lock within the sleeve.

15 Claims, 4 Drawing Sheets

TAMPER-PROOF DEVICE FOR LOCKINGLY ATTACHING A PIECE OF EQUIPMENT TO A SUPPORT BASE

BACKGROUND OF THE INVENTION a) Field of the Invention

The present invention relates to a tamper-proof device for lockingly attaching a piece of equipment such as a television set, a videocassette recorder, a microwave oven, a computer and the like, to a rigid support base.

b) Brief Description of the Prior Art

In numerous public and private places where pieces of equipment like those mentioned hereinabove are installed for use by the public, by clients and/or by the personnel, a substantial number of thefts are noticed. TV sets, VC recorders, microwave ovens, computer terminals and the like are stolen on a regular basis, whatever be the precautions taken for preventing the same.

The above problem is also encountered with a great number of other pieces of equipment.

SUMMARY OF THE INVENTION

The object of the present invention is to provide a tamper-proof device which reduces as much as possible the opportunity of thefts to steal pieces of equipment left "open" to the public.

More particularly, the object of the invention is to provide a tamper-proof device which is very simple in structure and thus inexpensive to manufacture and yet is very efficient, for lockingly attaching a piece of equipment like those mentioned hereinabove to a support base.

In accordance with the invention, this object achieved with a tamper-proof device for lockingly attaching a piece of equipment to a support base, comprising:

a) a first rigid member comprising:
- a first plate having two opposite sides hereinafter called "inner" and "outer" sides and
- at least one first hooking element rigidly fixed to the inner side of the first plate;

b) a second rigid member comprising:
- a second plate having two opposite sides hereinafter called "inner" and "outer" sides, and a second peripheral edge;
- a flange integral to and projecting from the second peripheral edge of the second plate over a given height, this flange defining a closed area adjacent to the inner side of the second plate, the closed area being sized to receive the first plate with the at least one first hooking element of the first rigid member projecting within the closed area; and
- at least one second hooking element rigidly fixed to the inner side of the second plate, said at least one second hooking element being shaped and positioned to fit into and be locked with said at least one first hooking element when the first plate is inserted into the closed area of the second plate.

First fixation means are provided for rigidly connecting the outer side of the first plate of the first member to one of said piece of equipment and support base. These first fixation means are accessible only when the first and second members are separated from each other.

Second fixation means are also provided for rigidly connecting the outer side of the second plate of the second member to the other one of said piece of equipment and support base. These second fixation means are accessible only when said first and second members are separated from each other.

Third fixation means are fixed to the inner sides of the first and second plates in order to rigidly connect these first and second plates together after the first plate has been inserted into the closed area of the second plate and said at least one first and second hooking elements are locked with each other. The third fixation means include a screwable bolt that can be reached and actuated through a circular opening provided in a given portion of the flange of the second member, the bolt and opening having a same axis perpendicular to the aforesaid portion of the flange.

A cylindrical sleeve integral to the second member projects within the closed area of this second member. This sleeve is coaxial to the bolt and the circular opening and has one end in open communication with the opening and another opposite end at a short distance away from the bolt of the third fixation means.

The device further comprises a key-operated lock comprising a cylindrical barrel from which a spring-loaded latch projects radially outwardly. The barrel is sized to pass through the cylindrical opening and snugly fit into the sleeve of the second plate with the latch extending in locking position out of the sleeve at the opposite end thereof within the closed area.

Last of all, a resilient plate is fixed to the second member in such a manner as to extend radially close to the opposite end of the sleeve in order to contact the latch when said latch projects radially outwardly of the sleeve. This plate is and must be resilient enough to let the latch flip over it if too much rotational force is applied to the barrel within the sleeve.

As can be understood, once it is installed, the flange extending all around the second member and the key-operated lock prevent access to the bolt and thus reduces the opportunity for non-authorized person to detach the first member from the second one and thus be in a position to steal the piece of equipment attached to one of them.

The fact that this lock is in the form of a barrel that is free to rotate within the sleeve even when its latch is locked in outward position, is very important. Indeed, such prevents a theft from breaking the latch by forcing the lock into rotation in a cantilever fashion. However, it is necessary that some pressure be exerted onto the latch to allow the key to be rotated within the barrel when one authorized person wants to open the same. In practice, this pressure is exerted by the resilient plate which must be strong enough to retain the latch and thus the barrel while the key is turned, but resilient enough to let the latch flip over it if the key is not in it and too much rotational force is applied to the barrel within the sleeve.

In accordance with a particularly preferred embodiment of the invention, the barrel of the lock is shorter in length than the sleeve. Thereby, when the barrel is inserted into the sleeve and locked within the same by its latch, the lock can only be opened with a key of extended length that is long enough to reach the barrel that is positioned "in recess" within the sleeve. This feature permits to further reduce the risk of stealing, since it prevents thefts from using conventional master-keys to unlatch the lock. Moreover, since the barrel is deep within the sleeve, access to the same is reduced, thereby reducing the risk of break of the lock.

Thanks to its structure, the tamper-proof device according to the invention is relatively "thin" and thus easily usable even in places where the space area is restricted. It does not affect the look of the piece of equipment or the look of the place where it is installed.

The invention and its numerous advantages will be better understood upon reading the following non-restrictive description of a preferred embodiment thereof, made with reference to the accompanying drawings.

DESCRIPTION OF A PREFERRED EMBODIMENT OF THE INVENTION

Figure 1:
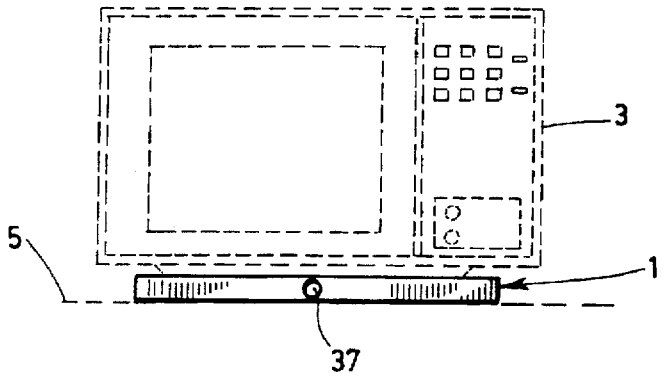
FIG. 1 is a front elevational view of a microwave oven lockingly attached to a support base by a tamper-proof device according to the invention.

The tamper-proof device 1 according to the preferred embodiment of the invention illustrated in the accompanying drawings is intended to be used for lockingly attaching a piece of equipment 3 to a rigid support base 5. In FIG. 1, the illustrated piece of equipment 3 is a microwave oven. However, it could be a television set, a videocassette recorder, a computer or any other kind of equipment of a given value that is susceptible of being stolen if left as such.

Figure 2:
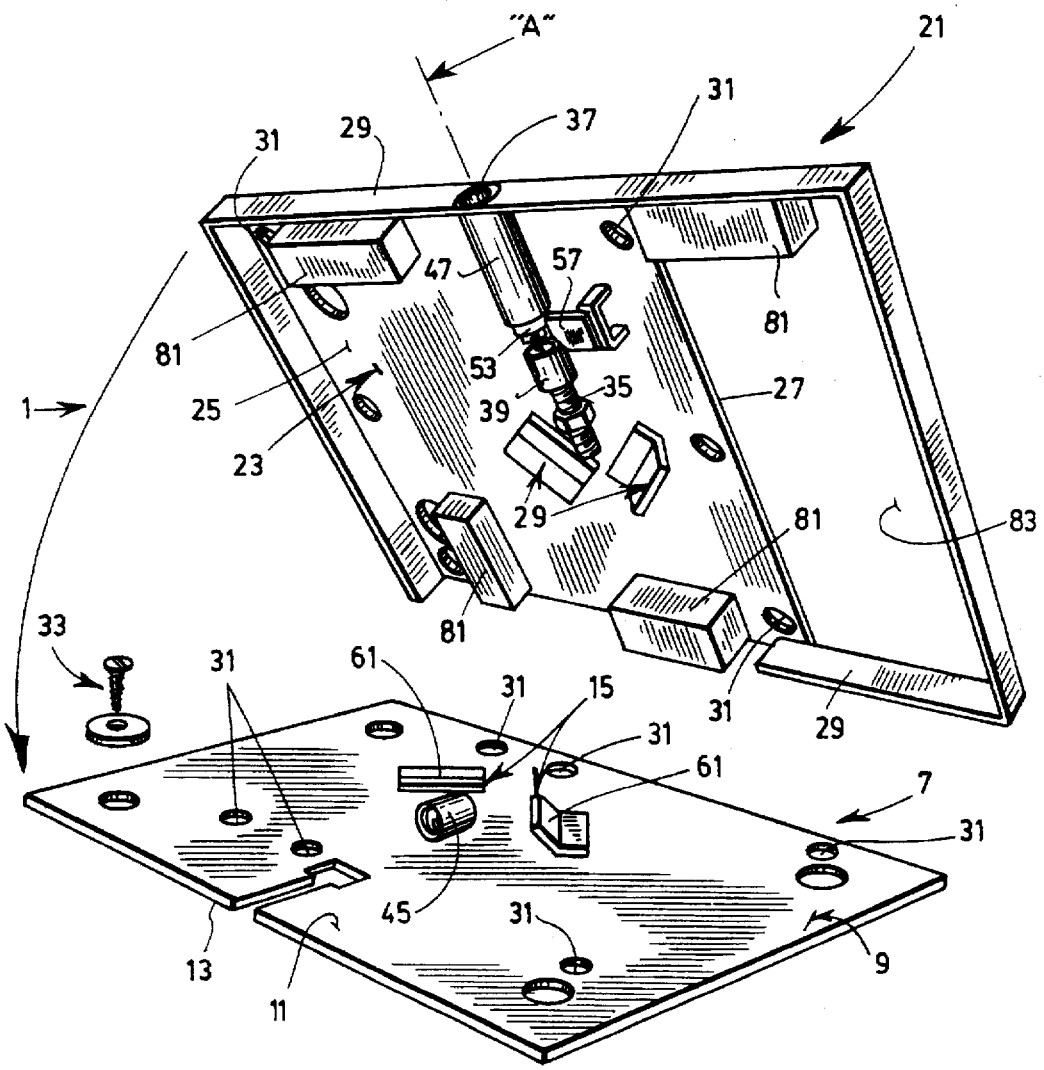
FIG. 2 is a perspective view of the tamper-proof device used in FIG. 1, shown in open position.
Figure 4:
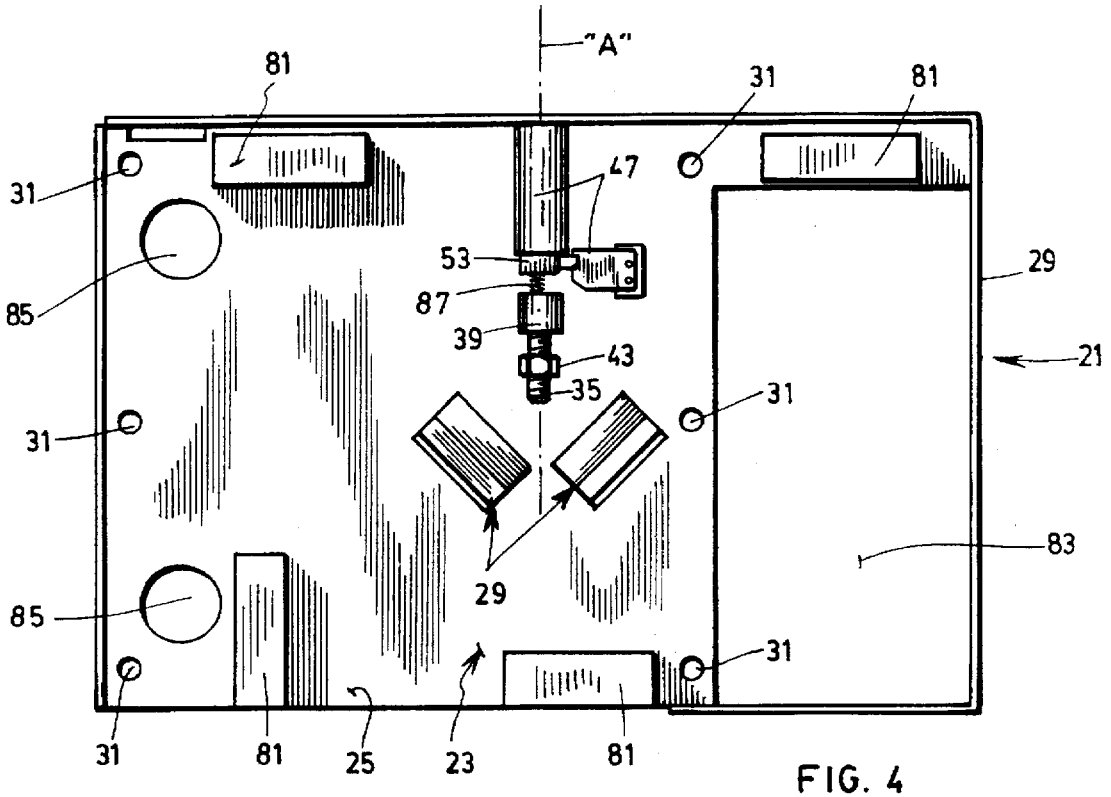
FIG. 4 is a bottom plan view of the second rigid member of the tamper-proof device shown in FIG. 2.
Figure 3:
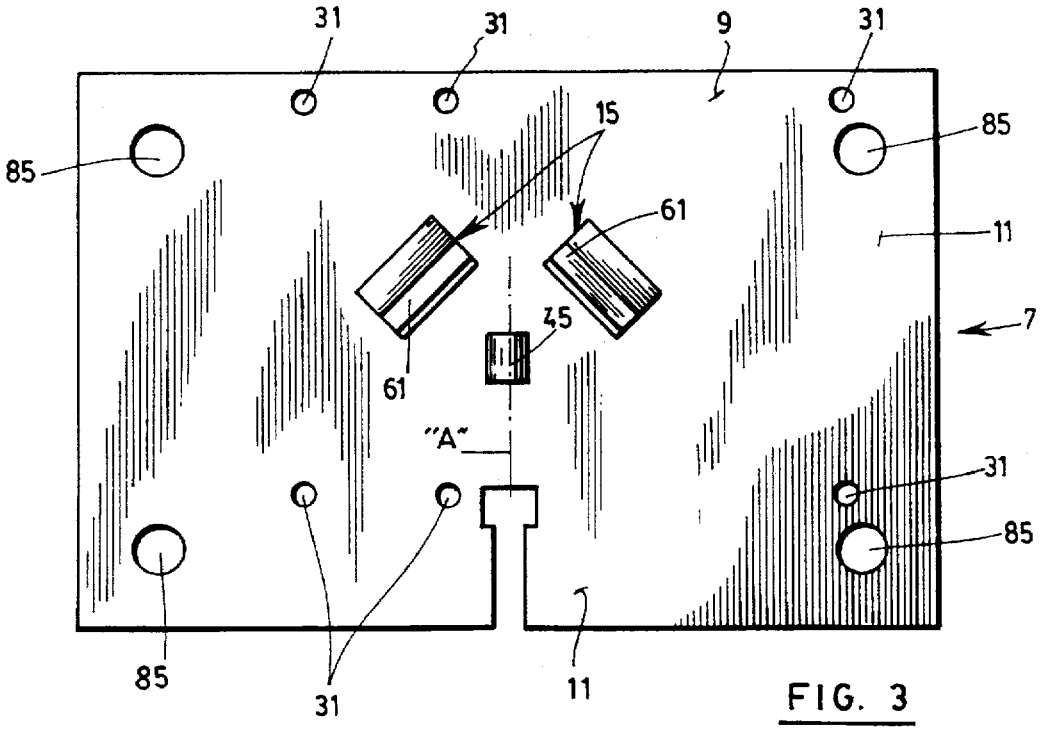
FIG. 3 is a top plan view of the first rigid member of the tamper-proof device shown in FIG. 2.

As is better shown in FIG. 2, the tamper-proof device 1 comprises a first rigid member 7 preferably made of steel. This first member 7 comprises a first plate 9 having two opposite sides 11, 13 hereinafter called "inner" and "outer" sides. It also comprises at least one first hooking element 15 that is rigidly fixed to the inner side 11 of the first plate 9 and will be described in greater detail hereinafter.

The tamper-proof device 1 also comprises a second rigid member 21 which is preferably made of steel. This second rigid member 21 comprises a second plate 23 having two opposite sides 25, 27 hereinafter called "inner" and "outer" sides, and a peripheral edge. A flange 29 integrally projects from the peripheral edge of the second plate 23 over a given height. This flange 29 defines a closed area adjacent to the inner side 25 of the second late 21. As is clearly shown in FIG. 2, the closed area that is so defined is sized to receive the first plate 9 with the at least one first hooking element 15 of the first rigid member 7 projecting within the closed area.

The second rigid member 21 also comprises at least one second hooking element 29 rigidly fixed to the inner side 25 of the second plate 23. This second hooking element that will also be disclosed in greater detail hereinafter is shaped and positioned to fit into and be locked with the first hooking element when the first plate 9 is inserted into the closed area of the second plate 23.

First fixation means are provided for rigidly connecting the outer side 13 of the first plate 9 of the first member 7 either to the piece of equipment 3 or, as is shown in FIG. 1, to the support base 5. Second fixation means are also provided for rigidly connecting the outer side 27 of the second plate 23 of the second member 21 to the other one of the piece of equipment 3 and support base 5. These first and second fixation means are accessible only when the first and second members 7 and 21 are separated from each other. From a practical standpoint, they may consists of holes 31 made in the first and second plates 9, 23 and of anchors 33 sized to fit into the holes 31 in order to connect the first and second plates to the piece of equipment 3 and support base 5, respectively. Alternatively, the fixation means may consists of weldings spots preferably made through the holes 31.

Third fixation means are provided on the inner sides 11, 25 of the first and second plates 9, 23 in order to rigidly connect these first and second plates together after the first plate 9 has been inserted into the closed area of the second plate 23 and the first and second hooking elements are locked with each other.

More particularly, these third fixation means comprise a screwable bolt 35 that can be reached with a screw driver and actuated through a circular opening 37 (see FIG. 2) provided in a given portion of the flange 29 of the second member 21. As is clearly shown, the bolt 35 and opening 37 have a same axis "A" perpendicular to the aforesaid portion of the flange 29. The bolt 35 is retained by a bolt-supporting member 39 in the form of a ring rigidly fixed to the inner side 25 of the second plate 23. The bolt-supporting member 39 is coaxial with the bolt 35 and the opening 37 made within the flange and must of course be sized to freely receive and hold the bolt 35 in line with respect to said opening, so that it is free to be screwed or unscrewed in the direction of the axis A. As is shown, the bolt 35 has a head 41 extending on the one side of the bolt supporting member 39 that is near the opening 37. A retaining nut 43 can be mounted onto the bolt 35 on the other side of the supporting member 39, to prevent it from accidentally moving out of the supporting member 39.

The third fixation means also comprise a nut member 45 rigidly fixed to the inner side 11 of the first plate 9. The nut member is positioned so as to be coaxial with the bolt 35 when the first plate 9 has been inserted into the closed area defined by the flange 29 of the second rigid member. The nut member 45 is sized to be screwed by the bolt 35.

A cylindrical sleeve 47 is rigidly fixed to the second member 21 so as to project within the closed area defined by the flange 29 of this second member. This sleeve 47 is coaxial to the bolt 35 and to the opening 37. It has a one end in open communication with the opening 37 and another opposite open end 49 that extends at a short distance away from the head 41 of the bolt. Preferably, the inner surface 51 of the opposite end 49 of the sleeve 47 (see FIG. 7) is slightly tapering radially outwardly.

The sleeve 47 is devised and sized to receive a key-operated lock 53 of conventional structure, which comprises a cylindrical barrel from which a spring-loaded latch 55 projects radially outwardly. The barrel 53 is sized to pass through the cylindrical opening 37 and snugly fit into the sleeve 47 attached to the second plate 23 with the latch 55 extending in locking position out of the sleeve 47 at the opposite end 49 thereof, within the closed area (see FIG. 7).

Thanks to the tapering shape of its opposite end 49, the sleeve 47 makes the removal of the barrel 53 much easier to carry out, with no need for a guiding slot for the latch 55 which would make the manufacture of the sleeve more expensive and would give the opportunity for a theft to reach the latch 55 and push it back in open position.

Figure 7:
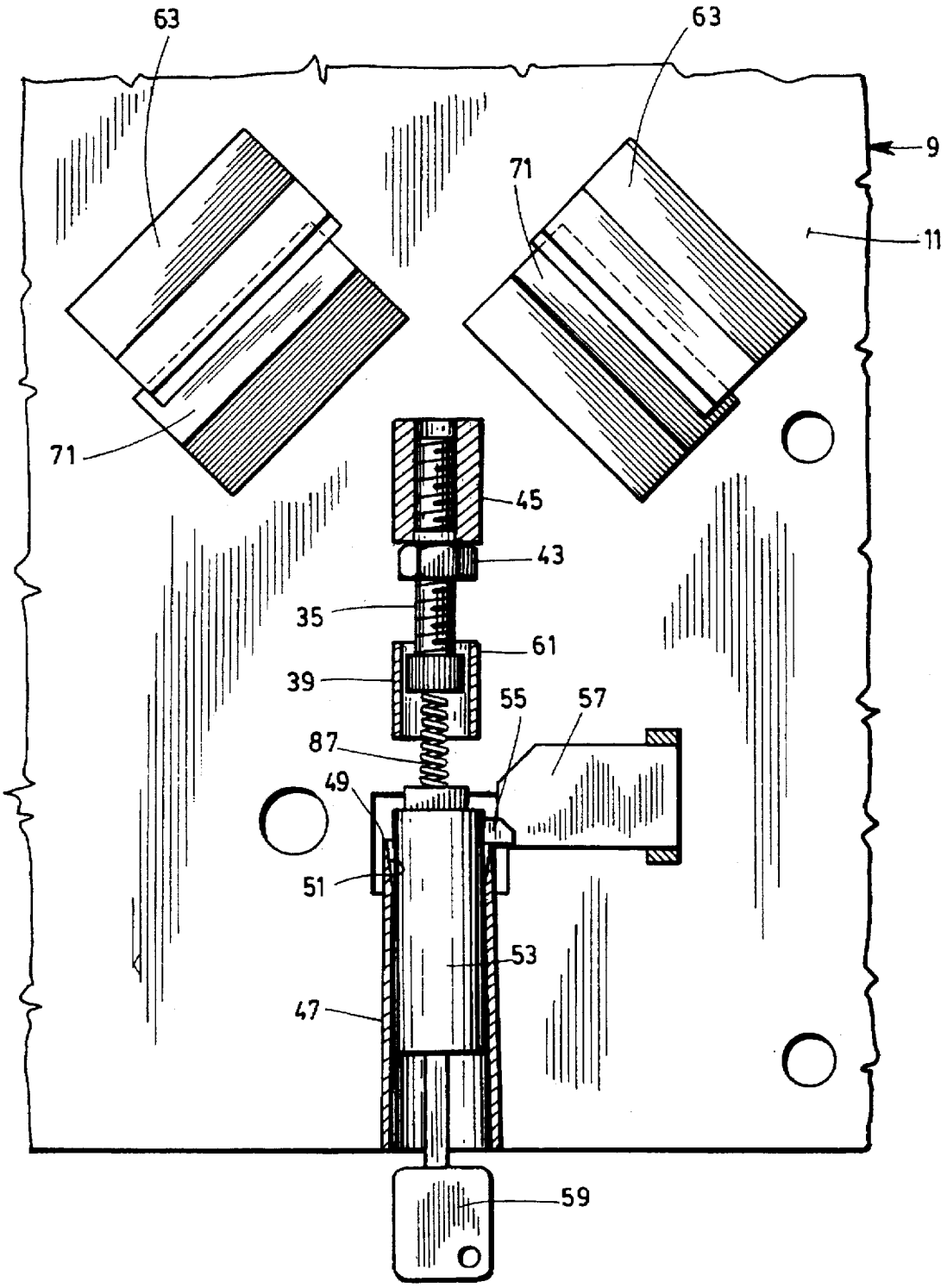
FIG. 7 is a partial cross-sectional view taken along line VII—VII of FIG. 6.

A resilient plate 57 is fixed to the second member 21 in such a manner as to extend radially with respect to the sleeve 47 close to the opposite end 49 of this sleeve in order to contact the latch 55 when this latch projects radially outwardly of the sleeve, as is shown in FIG. 7. In accordance with the invention, this plate 57 must be resilient enough to let the latch 55 flip over it if too much rotational force is applied to the barrel 53 within the sleeve 47.

Figure 5:
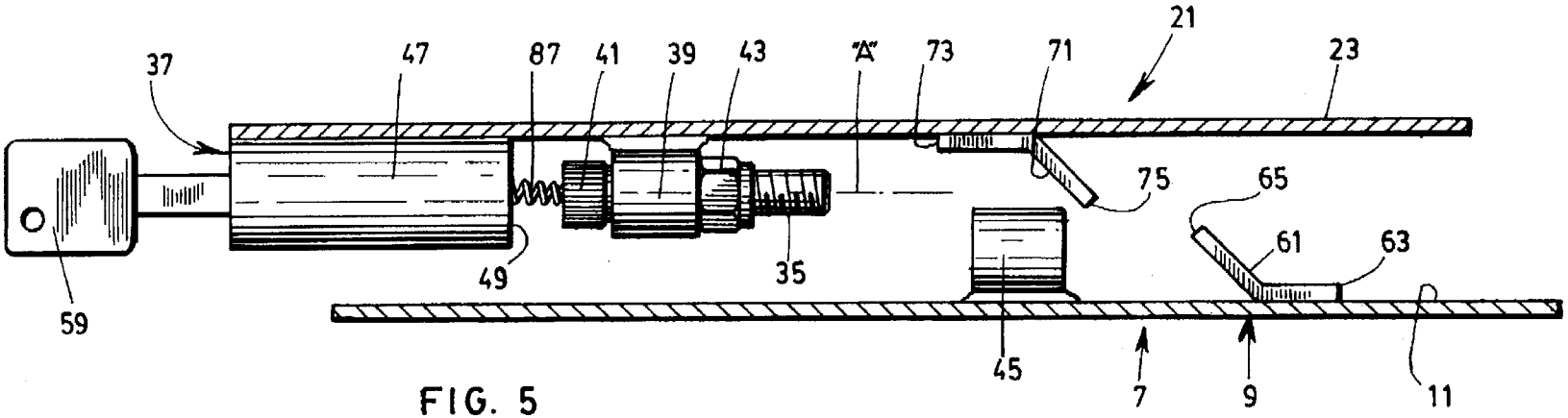
FIGS. 5 and 6 are partial side elevational views of the fixation means used to lockingly attach both rigid members together, just before and after assembly.
Figure 6:
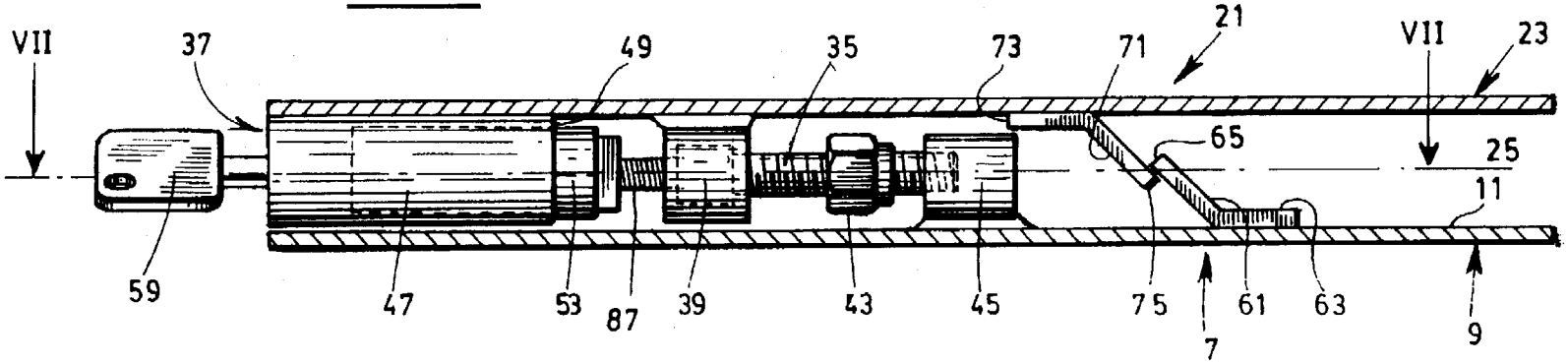

As it was already briefly indicated hereinabove, the first and second hooking elements 15, 29 are respectively positioned onto the first and second plates 9, 23 in such positions as to ensure that they fit into each other and get locked when, after insertion of the first plate 9 into the closed area of the second plate 23, the bolt 35 is screwed into the nut member 45 and the first plate 9 is accordingly slid toward the portion of the flange 29 of the second member 21 where is located the circular opening 37 (see the two positions shown in FIGS. 5 and 6).

As is shown in the attached drawings, the first hooking element 15 preferably comprises two wedges 61 each consisting of a plate having one edge 63 rigidly fixed to the inner side 11 of the first plate 9 and another edge 65 that extends at a distance away from the inner side 11 of the first plate. The other edge 65 is closer to the opening 37 than the one edge 63. The two wedges 61 are symmetrically positioned at an angle with respect to the axis "A" of the bolt 35 and nut member 45.

The second hooking element 29 preferably comprises two other wedges 71 each consisting of a plate having one edge 73 rigidly fixed to the inner side 25 of the second plate 23 and another edge 75 that extends at a distance away from the inner side 25 of the second plate. This other edge 75 is farther from the opening 37 than the one edge 73. Once again, the two wedges 71 are symmetrically positioned at an angle with respect to the axis "A" of the bolt 35 and nut member 45. They are also positioned in such a manner that when the bolt 35 is screwed into the nut member 45, the wedges 61, 71 engage into each other and force the first and second plates 9 and 23 to move down towards each other within the closed area and thus be solidly locked (see FIGS. 5 and 6). Thus, the wedges 61, 71 cooperate in use to prevent the first and second plates from being moved with respect to each other in any direction (upwards, forwards rearwards and laterally).

However, it is worth mentioning that any other kind of hooking elements that would work in the same way and give the same result, could be used if desired.

As is can now be better understood, once it is installed, the flange 29 and the key-operated lock 53 prevent access to the bolt 35 used to attach together the first and second members. Such reduces the opportunity for a non-authorized person to detach the first member 7 from the second one 21 (or vice versa) and thus be in a position to steal the piece of equipment 3 attached to one of them.

The fact that the lock 53 is in the form of a barrel that is free to rotate within the sleeve 47 even when the latch 55 is locked in outward position 55 is very important. Indeed, such prevents a theft from breaking the latch by forcing the lock into rotation in a cantilever fashion. However, it is necessary that some pressure be exerted onto the latch to allow the key 59 to be rotated within the barrel 53 when one authorized person wants to open the same. In practice, this pressure is exerted by the resilient plate 57 which must be strong enough to retain the latch 55 and thus the barrel 53 while the key 59 is turned, but resilient enough to let the latch 55 flip over it if the key 59 is not in it and too much rotational force is applied to the barrel within the sleeve.

In accordance with a particularly preferred embodiment of the invention, the barrel 53 of the lock is shorter in length than the sleeve 47. Thereby when the barrel 53 is inserted into the sleeve 47 and locked therein with the latch 55, the lock 53 can only be opened with a "non-conventional" key 59 of extended length that is long enough to reach the barrel within the sleeve. This prevents thefts from using master keys to unlatch the lock and steal the piece of equipment 3.

As is better shown in FIG. 2, the second rigid member 21 may also comprise a plurality of support members 81 fixed to the second plate 23 within the closed area to keep the first plate 9 parallel to the second plate while the first plate is inserted and locked. Preferably, the support members 81 consists of rubber blocks glued onto the inner side 25 of the second plate 23 such members permit to absorb shocks and vibrations. If desired, a spring 87 bearing against the head 41 of the bolt 35 can also be used to prevent the barrel from moving in back and fro when it is locked.

As is also shown, the first and/or second plates 9, 23 and the flange 29 may have further openings 83, 85, made therein to give access to wires or other structural components such as legs or motors projecting from the piece of equipment 3, the support base 5 or both of them.

Of course, numerous modifications could be made of the above described embodiment without departing from the scope of the invention as defined in the appended claims.

We claim:

1. A tamper-proof device for lockingly attaching a piece of equipment to a support base, comprising:

a) a first rigid member comprising:

a first plate having two opposite sides hereinafter called "inner" and "outer" sides; and at least one first hooking element rigidly fixed to the inner side of the first plate;

b) a second rigid member comprising:

a second plate having two opposite sides hereinafter called "inner" and "outer" sides and a peripheral edge;

a flange integral to and projecting from the peripheral edge of the second plate over a given height, said flange defining a closed area adjacent to the inner side of said second plate, said closed area being sized to receive the first plate with said at least one first hooking element of the first rigid member projecting within said closed area; and at least one second hooking element rigidly fixed to the inner side of the second plate, said at least one second hooking element being shaped and positioned to fit into and be locked with said at least one first hooking element when the first plate is inserted into the closed area of the second plate;

c) first fixation means for rigidly connecting the outer side of the first plate of the first member to one of said piece of equipment and support base, said first fixation means being accessible only when said first and second members are separated from each other;

d) second fixation means for rigidly connecting the outer side of the second plate of the second member to the other one of said piece of equipment and support base, said second fixation means being accessible only when said first and second members are separated from each other;

e) third fixation means fixed to the inner sides of the first and second plates in order to rigidly connect said first and second plates together after the first plate has been inserted into the closed area of the second plate and said at least one first and second hooking elements are locked with each other, said third fixation means including a screwable bolt that can be reached and actuated through a circular opening provided in a given portion of the flange of the second member, the bolt and opening having a same axis perpendicular to the aforesaid portion of the flange;

f) a cylindrical sleeve integral to the second member and projecting within the closed area of said second member, said sleeve being coaxial to the bolt and the circular opening and having one end in open communication with said opening and another opposite end at a short distance away from the bolt;

g) a key-operated lock comprising a cylindrical barrel from which a spring-loaded latch projects radially outwardly, said barrel being sized to pass through the cylindrical sleeve and snugly fit into the sleeve of the second plate with the latch extending in locking position out of the sleeve at the opposite end thereof within the closed area, and h) a resilient plate fixed to the second member in such a manner as to extend radially with respect to the sleeve close to the opposite end of said sleeve in order to contact the latch when said latch projects radially outwardly of the sleeve, said plate being resilient enough to let the latch flip over it if too much rotational force is applied to the barrel within the sleeve.

2. The tamper-proof device of claim 1, wherein:

the third fixation means comprises a bolt-supporting member rigidly fixed to the inner side of the second plate at said short distance from the opposite end of the sleeve, said bolt-supporting member being coaxial with the bolt sleeve and the opening within the flange and being sized to freely receive and hold the bolt in line with respect to said sleeve and opening;

the third fixation means also comprises a nut member rigidly fixed to the inner side of the first plate, said nut member being coaxial with said bolt when the first plate has been inserted into the closed area of the second plate, said nut member being sized to be screwed by the bolt; and said at least one first and second hooking elements are respectively positioned onto the first and second plates in such positions as to ensure that they fit into each other and get locked when, after insertion of the first plate into the closed area of the second plate, the bolt is screwed into the nut member and the first plate is, accordingly, slightly slid toward the portion of the flange of the second member where is located the circular opening.

3. The tamper-proof device of claim 2, wherein:

said at least one first hooking element comprises a first wedge consisting of a plate having one edge rigidly fixed to the inner side of the first plate and another edge extending at a distance away from said inner side of said first plate, said another edge being closer to the circular opening than said one edge of said first wedge; and said at least one second hooking element comprises a second wedge consisting of a plate having one edge rigidly fixed to the inner side of the second plate and another edge extending at a distance away from said inner side of said second plate, said another edge being farther from the circular opening than said one edge of said second wedge;

whereby, when the bolt is screwed into the nut member, the first and second wedges engage into each other and force the first and second plates to move down towards each other within the closed area and thus be solidly locked.

4. The tamper-proof device of claim 3, wherein said at least one first and second hooking elements each comprises two of said first and second wedges, respectively, which are symmetrically positioned at an angle with respect to the axis of the bolt and nut member in such a manner as to cooperate with each other and prevent the first and second plates from being moved with respect to each other in any direction.

5. The tamper-proof device of claim 4, wherein the sleeve has an inner surface that is slightly tapering radially outwardly at its opposite end.

6. The tamper-proof device of claim 5, wherein said first and second fixation means comprise holes made in said first and second plates and anchors sized to fit into said holes in order to connect each one of said first and second plates to the piece of equipment and support base, respectively.

7. The tamper-proof device of claim 6, wherein the second rigid member also comprises support members fixed to the second plate within the closed area to keep the first plate parallel to the second plate while the first plate is inserted and locked.

8. The tamper-proof device of claim 7, wherein the support members consists of rubber blocks.

9. The tamper-proof device of claim 8, wherein the bolt has a head projecting from the bolt-supporting member towards the sleeve and a retaining nut located opposite to the head with respect to said bolt-supporting member.

10. The tamper-proof device of claim 9, wherein at least one of said first and second plates and said flange has at least one further opening to give access to wires or other structural components projecting from said piece of equipment, said support base or both of them.

11. The tamper-proof device of claim 3, wherein the second rigid member also comprises support members fixed to the second plate within the closed area to keep the first plate parallel to the second plate while the first plate is inserted and locked.

12. The tamper-proof device of claim 11, wherein the support members consists of rubber blocks.

13. The tamper-proof device of claim 3, wherein the barrel of the lock is shorter in length than the sleeve, whereby when said barrel is inserted into said sleeve and locked therein with the latch, the lock can only be opened with a key of extended length that is long enough to reach the barrel within the sleeve.

14. The tamper-proof device of claim 9, wherein the barrel of the lock is shorter in length than the sleeve, whereby when said barrel is inserted into said sleeve and locked therein with the latch, the lock can only be opened with a key of extended length that is long enough to reach the barrel within the sleeve.

15. The tamper-proof device of claim 11, wherein the barrel of the lock is shorter in length than the sleeve, whereby when said barrel is inserted into said sleeve and locked therein with the latch, the lock can only be opened with a key of extended length that is long enough to reach the barrel within the sleeve.

* * * * *